US011346185B2

(12) United States Patent
Jacobsen

(10) Patent No.: US 11,346,185 B2
(45) Date of Patent: May 31, 2022

(54) INTEGRATING WELLS IN TOWABLE SUBSEA UNITS

(71) Applicant: Subsea 7 Norway AS, Stavanger (NO)

(72) Inventor: Terje Berg Jacobsen, Stavanger (NO)

(73) Assignee: Subsea 7 Norway AS, Stavanger (NO)

( * ) Notice: Subject to any disclaimer, the term of this patent is extended or adjusted under 35 U.S.C. 154(b) by 0 days.

(21) Appl. No.: 16/960,050

(22) PCT Filed: Jan. 4, 2019

(86) PCT No.: PCT/EP2019/050177
§ 371 (c)(1),
(2) Date: Jul. 3, 2020

(87) PCT Pub. No.: WO2019/134976
PCT Pub. Date: Jul. 11, 2019

(65) Prior Publication Data

US 2021/0054723 A1 Feb. 25, 2021

(30) Foreign Application Priority Data

Jan. 4, 2018 (GB) ..... 1800118

(51) Int. Cl.
*E21B 7/12* (2006.01)
*E21B 33/035* (2006.01)
*E21B 41/08* (2006.01)

(52) U.S. Cl.
CPC ..... *E21B 41/08* (2013.01); *E21B 7/12* (2013.01); *E21B 33/035* (2013.01)

(58) Field of Classification Search
CPC ..... E21B 7/12; E21B 33/035; E21B 41/08
See application file for complete search history.

(56) References Cited

U.S. PATENT DOCUMENTS

| | | | | |
|---|---|---|---|---|
| 4,784,527 | A | 11/1988 | Hunter et al. | |
| 4,822,212 | A | 4/1989 | Hall et al. | |
| 9,080,408 | B2 | 7/2015 | Mogedal | |
| 9,140,089 | B2 * | 9/2015 | Strand | E21B 33/035 |
| 9,217,315 | B2 * | 12/2015 | Mogedal | E21B 33/037 |
| 10,253,569 | B2 * | 4/2019 | Ellison | E21B 33/043 |
| 10,344,551 | B2 * | 7/2019 | Ellingson | E21B 33/037 |
| 2009/0297276 | A1 | 12/2009 | Foo et al. | |

(Continued)

FOREIGN PATENT DOCUMENTS

| | | |
|---|---|---|
| EP | 0 336 492 | 10/1989 |
| EP | 3 163 011 | 5/2017 |

(Continued)

*Primary Examiner* — Matthew R Buck
(74) *Attorney, Agent, or Firm* — Levy & Grandinetti

(57) ABSTRACT

A drilling conductor supported within a suction anchor is installed by lowering the suction anchor through the top of a frame of a subsea processing unit. The base of the frame defines a landing area for the suction anchor and supports a fixing system for fixing the suction anchor to the frame. When the suction anchor has been embedded into the seabed beneath the processing unit, the frame is fixed to the suction anchor to form a structural unit that includes the conductor, the suction anchor and the frame. Additional equipment such as a blow-out presenter or a Christmas tree is lowered through the top of the frame and onto the conductor that is supported by the embedded suction anchor.

29 Claims, 8 Drawing Sheets

(56) References Cited

U.S. PATENT DOCUMENTS

| | | | | |
|---|---|---|---|---|
| 2012/0000665 | A1 | 1/2012 | Omvik | |
| 2012/0024535 | A1 | 2/2012 | Lieske, II | |
| 2019/0162038 | A1* | 5/2019 | Rein S | E21B 33/035 |
| 2019/0323325 | A1* | 10/2019 | Hestetun | E21B 41/04 |
| 2019/0376250 | A1* | 12/2019 | Grytdal | E21B 41/08 |
| 2020/0198735 | A1* | 6/2020 | Rein S | E21B 41/0007 |

FOREIGN PATENT DOCUMENTS

| | | |
|---|---|---|
| GB | 2509165 | 6/2014 |
| WO | WO 03/071092 | 8/2003 |
| WO | WO 2011/162616 | 12/2011 |
| WO | WO 2013/167872 | 11/2013 |
| WO | WO 2016/200271 | 12/2016 |
| WO | WO 2017/035606 | 3/2017 |
| WO | WO 2017/155415 | 9/2017 |
| WO | WO 2017/179992 | 10/2017 |

* cited by examiner

INTEGRATING WELLS IN TOWABLE SUBSEA UNITS

This invention relates to towable subsea units for use in the oil and gas industry to treat or process fluids underwater. Aspects of the invention extend the capabilities of subsea manifolds.

Drilling templates are commonly used in the subsea oil and gas industry to guide subsea wells. U.S. Pat. Nos. 4,784,527 and 4,822,212 disclose typical examples of such templates.

Briefly, a template comprises a frame that is disposed upon and anchored into the seabed, with funnelled slots into which tubular conductors can be inserted. The conductors penetrate the seabed to guide well casings. The template provides a foundation on the seabed to ensure lateral stability and to resist weight loads.

U.S. Pat. No. 8,025,463 describes how suction piles may be integrated into a flat bearing foundation to increase the capacity of the foundation. Similarly, WO 2017/179992 relates to a subsea well foundation comprising an integral suction anchor.

EP3163011 shows a well template that is secured to the seabed by a group of suction anchors that together form a foundation.

WO 2013/167872 relates to a well drilling template in which pre-installed suction anchors are integral to conductors and wellheads.

In U.S. Pat. No. 8,950,500, a template comprising slots for suction piles allows installation of casings and wellheads guided inside the suction pile body. The suction pile and the template structure are said to be coupled by a hydraulic device but there is no explanation of how such a device would work.

WO 2011/162616 shows a suction pile guiding a conductor for a wellhead. The suction pile comprises a superstructure on its top, whose purpose is to stabilise the wellhead and the conductor.

In U.S. Pat. No. 9,080,408, wellheads are secured and coupled to a template frame, the frame itself being laid onto suction piles.

EP 0336492 teaches integrating a drilling template into a towhead.

There is a need to position large and heavy items of wellhead equipment such as a blowout preventer (BOP) or a Christmas tree atop a subsea well. It is challenging to align that equipment and to support its weight with a compact towable structure, while facilitating the connections required for that equipment to perform its job.

Against this background, the invention provides a method of installing a drilling conductor for a subsea well. The method comprises: supporting the conductor within a suction anchor, or providing a suction anchor that is arranged to support, or capable of supporting, the conductor within; lowering the suction anchor toward a subsea processing unit at a seabed location, the processing unit having a frame defining a base that lies on the seabed and a top spaced from the base to accommodate equipment on board the processing unit; lowering the suction anchor into the processing unit through the top of the frame; embedding the suction anchor into the seabed beneath the processing unit; and fixing the frame to the embedded suction anchor to form a structural unit that comprises the conductor, the suction anchor and the frame.

The suction anchor is preferably lowered and embedded with the conductor already supported within.

Preliminarily, the processing unit may be towed to an offshore installation site at which the unit is landed onto the seabed.

The method may further comprise lowering additional equipment such as BOP or a Christmas tree through the top of the frame and onto the conductor that is supported by the embedded suction anchor. The weight load of the additional equipment may then be transferred to the embedded suction anchor, before or after fixing the frame to the embedded suction anchor.

One or more elongate guide elements may be connected directly or indirectly to the embedded suction anchor, enabling the additional equipment to be lowered along the or each guide element. Conveniently, the additional equipment may be lowered through the top of the frame along the or each guide element. In that case, the guide element suitably extends upwardly from the embedded suction anchor and protrudes from the unit above the top of the frame. An opening in the frame above the additional equipment may then be closed.

After lowering the additional equipment onto the conductor, power, control and/or fluid connections may be made between the additional equipment and the equipment on board the subsea processing unit.

A well may be drilled through the conductor before the additional equipment is lowered onto the conductor.

The frame may be fixed to the embedded suction anchor by extending one or more clamps from the frame into clamping engagement with the suction anchor. Preferably, two or more clamps are extended into clamping engagement with the suction anchor, those clamps being extendable from the frame to different extents relative to each other.

The suction anchor may be landed on the seabed within a landing area defined by the frame, before being embedded into the seabed. The landing area may be substantially wider than the suction anchor. The suction anchor may be aligned with the landing area by making aligning contact between the suction anchor and the frame while lowering the suction anchor toward the seabed.

Fixing the frame to the embedded suction anchor may involve resting a brace that extends laterally from the suction anchor onto at least one member that defines the frame.

The inventive concept embraces a subsea processing unit that comprises: a frame having a base arranged to lie on the seabed; and on-board equipment mounted on the base. The base of the frame defines a landing area for a suction anchor and supports a fixing system for fixing the suction anchor to the frame. The frame further comprises a top spaced from the base, the top of the frame having an opening over the landing area for receiving the suction anchor.

The fixing system suitably comprises one or more clamp shoes that are extendable from the frame toward the landing area, and preferably comprises two or more clamp shoes that are extendable from the frame in mutually-opposed directions. The clamp shoes may be operable individually to be extended from the frame to different extents relative to each other. Guide formations may be provided, those formations being shaped to guide the suction anchor into alignment with the landing area.

The inventive concept also embraces the subsea processing unit when installed on the seabed. Thus, the unit is then in combination with at least one suction anchor that is embedded into the seabed within the landing area and that is fixed by the fixing system to the frame, the or each suction anchor containing and supporting a tubular drilling conductor.

The or each suction anchor may be surmounted by an anchor brace that connects the drilling conductor to the suction anchor. The anchor brace may define upwardly-facing locating points for additional subsequently-installable wellhead equipment. As part of the fixing system, the anchor brace may overlap at least one adjacent member of the frame so as to lie upon that member.

At least one upwardly-extending elongate guide element may be connected to the or each suction anchor. In that case, the or each guide element is conveniently attached to a locating point of the anchor brace.

The unit may further comprise additional wellhead equipment such as a blow-out preventer or a Christmas tree mounted on the conductor. In that case, there may be power, control and/or fluid connections between the additional wellhead equipment and the on-board equipment of the unit.

In order to minimise the cost of a subsea field development, a production system may be implemented in a towable unit. Production wells or injection wells may also be integrated into such a unit. This removes the need for separate satellite wells. Thus, integrated-well solutions may be useful for subsea processing plants that use a towable production or processing system.

Integrated-well solutions may also be useful for subsea water management. In this case, a separate towable structure may contain all of the treatment units needed for seawater injection to enhance oil production and to re-use treated water. Conveniently, therefore, the structure may include an injection well.

The invention integrates a drilling template into a subsea processing unit (SPU) that implements a towable production system. The invention uses the towable structure to give additional foundation support for the well. This brings various benefits.

For example, clamps between the towable structure and a suction anchor that incorporates a conductor increase the foundation capacity. Thus, the suction anchor foundation may be reduced in size, yet increased foundation strength allows for a larger BOP or other wellhead structure. Also, the invention enables a towable production system to be used to perform drilling operations in shallow reservoirs by removing the need for a conductor to be as long as in the prior art, typically 70 m-100 m.

This invention solves the problem of integrating well slots into a towable structure and fits well with the design principles of known towable production systems.

A Christmas tree may be integrated into the towable structure, hence removing the need for a satellite structure with associated flowlines and flying leads. The invention enables controlled dimensions for interfacing connectors between the Christmas tree and a manifold implemented in the structure.

The SPU structure provides a permanent guide base that allows for well expansion, and may be designed to allow for expansion in a towhead of a pipeline bundle.

In principle, the suction anchor could be installed before the SPU or together with the SPU. The latter would reduce scheduling risk. However, installing the suction anchor after the SPU is described in this specification and is currently preferred.

The rigid connection of the suction anchor to the SPU increases the foundation capacity. Making that connection by clamping the SPU to the suction anchor allows generous positional tolerances.

Embodiments of the invention implement a method to install conductors for subsea wells. The method comprises:

installing a template structure on the seabed, the template structure comprising a substantially horizontal bearing foundation;

installing at least one suction pile through a pre-existing slot of the template structure;

coupling the suction pile with the template structure; and installing a conductor pipe through a guiding tunnel of the suction pile.

The method may further comprise installing apparatus such as a wellhead, Christmas tree or BOP on the top of the conductor and mechanically coupling that apparatus to the template structure.

The pre-existing, integrated overtrawlable frame of the unit protects the equipment within and gives additional lateral stability to any equipment connected to the conductor or suction anchor.

In summary, a drilling conductor supported within a suction anchor may be installed by lowering the suction anchor through the top of a frame of a subsea processing unit. The base of the frame defines a landing area for the suction anchor and supports a fixing system for fixing the suction anchor to the frame.

When the suction anchor has been embedded into the seabed beneath the processing unit, the frame is fixed to the suction anchor to form a structural unit that comprises the conductor, the suction anchor and the frame. Additional equipment such as a blow-out preventer or a Christmas tree may be lowered through the top of the frame and onto the conductor that is supported by the embedded suction anchor.

The size of the suction anchor will typically be chosen based on the quality of the seabed soil. Typically, the suction anchor will be required to withstand a bending moment of up to 3000 kNm.

As the suction anchor is a soil foundation and not a cement foundation, there is no need for a cement stinger or for a disposal system for cement and cuttings.

In order that the invention may be more readily understood, reference will now be made, by way of example, to the accompanying drawings in which.

Figure 1:
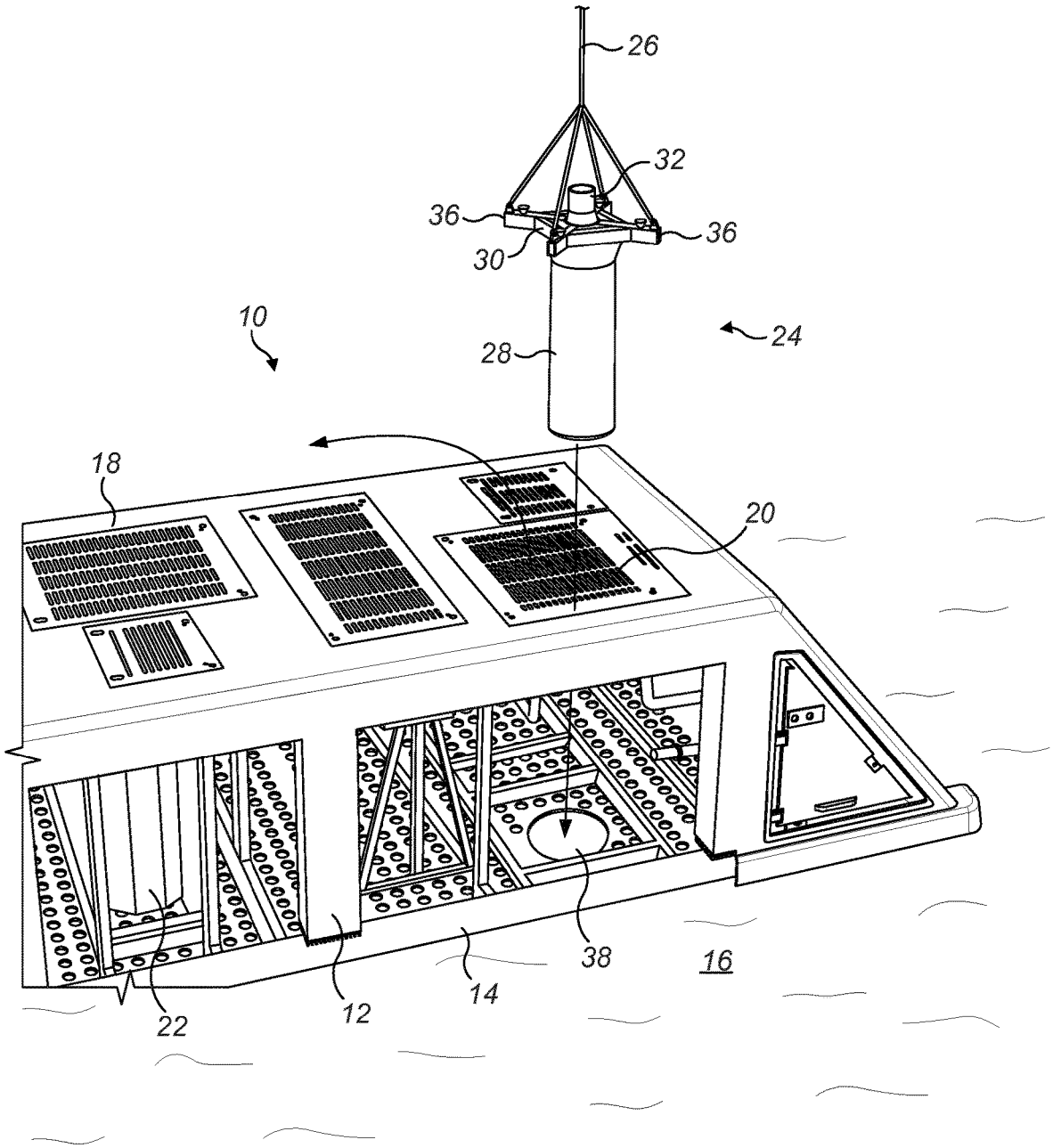
FIG. 1 is a perspective view of a suction anchor with an integrated conductor being lowered into a subsea processing unit on the seabed.
Figure 2:
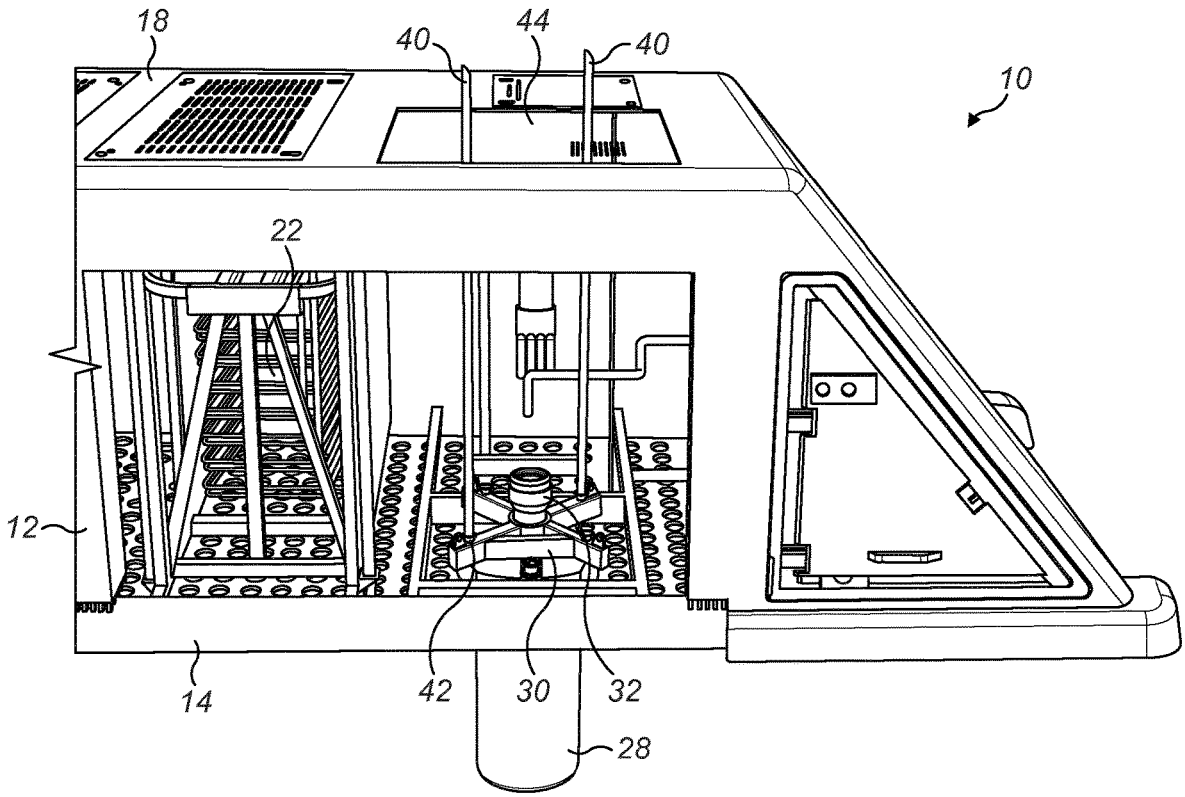
FIG. 2 is a perspective view of the subsea processing unit showing the suction anchor and the conductor now embedded in the seabed and guide posts upstanding from the suction anchor.

Referring firstly to FIGS. 1 and 2 of the drawings, an SPU 10 in accordance with the invention comprises a structural box-section lattice frame 12 that is fabricated from hollow structural members of welded steel construction.

In this example, the frame 12 is shaped as a regular trapezium in longitudinal section or in side view, with downwardly-tapering wedge-shaped ends. Thus, the shape of the SPU 10 defined by the frame 12 comprises a generally flat base 14 that lies upon the seabed 16 and a generally flat top 18 that is substantially parallel to the base 14 and hence also to the seabed 16.

In principle, the SPU 10 could be transported to the installation site aboard an installation vessel before being lowered from the surface to the seabed 16. However, the SPU 10 is preferably towed to an installation site, for example in mid-water using the controlled depth towing method (CDTM) known in the art. The SPU 10 may be a discrete unit or may be a towhead of an elongate pipeline bundle, which may have another towhead at the opposite end of the bundle.

When installed on the seabed 14, the SPU 10 is over-trawlable by virtue of its inclined ends and panels 20 that fit substantially flush to the top of the frame 12 to protect equipment housed within SPU 10.

The panels 20 may be moved or removed like a hatch for access from above to install or remove individual items of equipment 22 that are housed by the SPU 10 under the top 18 of the frame 12. The sides of the frame 12 may conveniently be left open as shown, providing access to the equipment 22 for routine maintenance and other operations by subsea intervention, for example using an ROV.

The equipment 22 on board the SPU 10 may include any apparatus or piping arrangement that interacts with, or controls the flow of, fluid flowing through pipework of the SPU 10. Thus, the equipment 22 may comprise a manifold and various items of processing apparatus. The processing apparatus may be arranged to process production fluids flowing from a subsea oil or gas well, or to process other fluids such as water used in, or resulting from, the production of oil or gas.

The equipment 22 on board the SPU 10 may also comprise other items of equipment for powering and controlling the manifold and processing apparatus, and optionally also for controlling the buoyancy and stability of the SPU 10 when it is being transported and installed. Other equipment may be included for subsea power generation, transmission or distribution.

Typically, apparatus for processing production fluid will comprise at least a water separator for removing water from the production fluid. More generally, processing apparatus housed by the SPU 10 may perform a variety of tasks including any of: gas/liquid separation; subsea boosting; subsea gas compression; gas treatment including dewpoint control; pipeline heating; seawater treatment and injection; and/or injection of chemicals. Chemicals may also be stored in the SPU 10, ready for injection.

FIG. 1 shows a suction anchor assembly 24 being supported in the water column by a winch or crane wire 26 hanging from a surface vessel (not shown) and being lowered into the SPU 10 from above. For this purpose, an appropriate one of the panels 20 on the top 18 of the SPU 10 is about to be moved aside, or removed as shown in FIG. 2, to provide access to the interior of the SPU 10 from above.

The suction anchor assembly 24 comprises a tubular suction pile or suction anchor 28. The suction anchor 28 is surmounted by a cruciform frame or anchor brace 30 and contains an integrated tubular conductor 32 that is free to move axially. The conductor 32 may, for example, have an internal diameter of thirty inches (762 mm).

Figure 4:
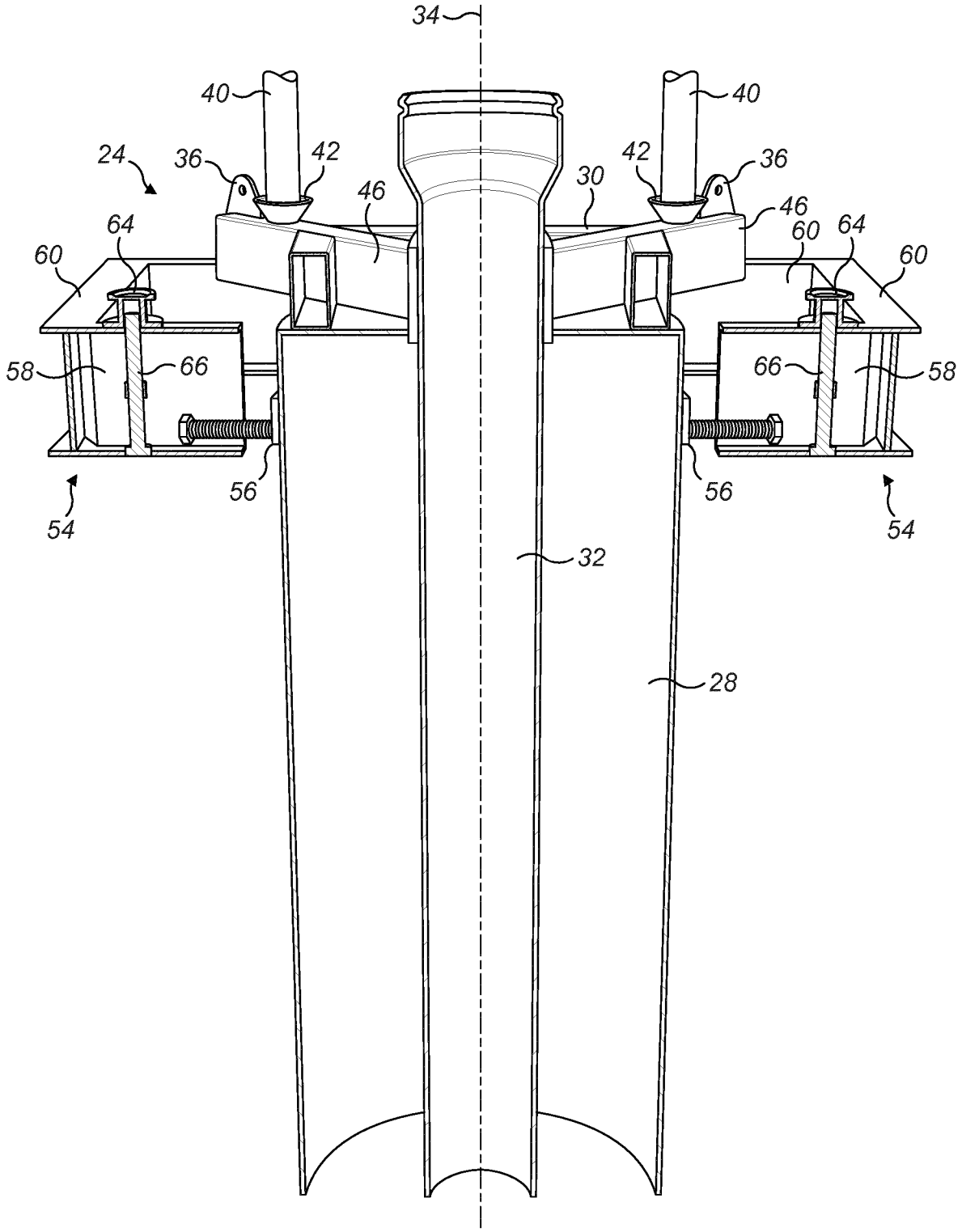
FIG. 4 is a perspective view of the suction anchor and the conductor in central longitudinal section.

As best appreciated in the sectional view of FIG. 4, the conductor 32 is concentric and coaxial with the surrounding tubular wall of the suction anchor 28, about a common central longitudinal axis 34. The conductor 32 hangs centrally from the anchor brace 30, which extends radially beyond the diameter of the suction anchor 28 to provide a spread of lifting points 36 for the wire 26.

The suction anchor assembly 24 is shown here being aimed into a dedicated slot or bay 38 within the SPU 10, where the base 14 of the SPU 10 is open to the seabed 16. Thus, shortly after the suction anchor assembly 24 enters the bay 38 through the top 18 of the frame 12, the edge of the skirt at the lower end of the suction anchor 28 will encounter the seabed 16.

Initially, the skirt of the suction anchor 28 embeds slightly into the seabed under self-weight. A suction pump can then be activated, for example by ROV or diver intervention, to draw water from within the suction anchor 28 to embed the suction anchor 28 and the conductor 32 more deeply into the seabed 16.

Figure 3:
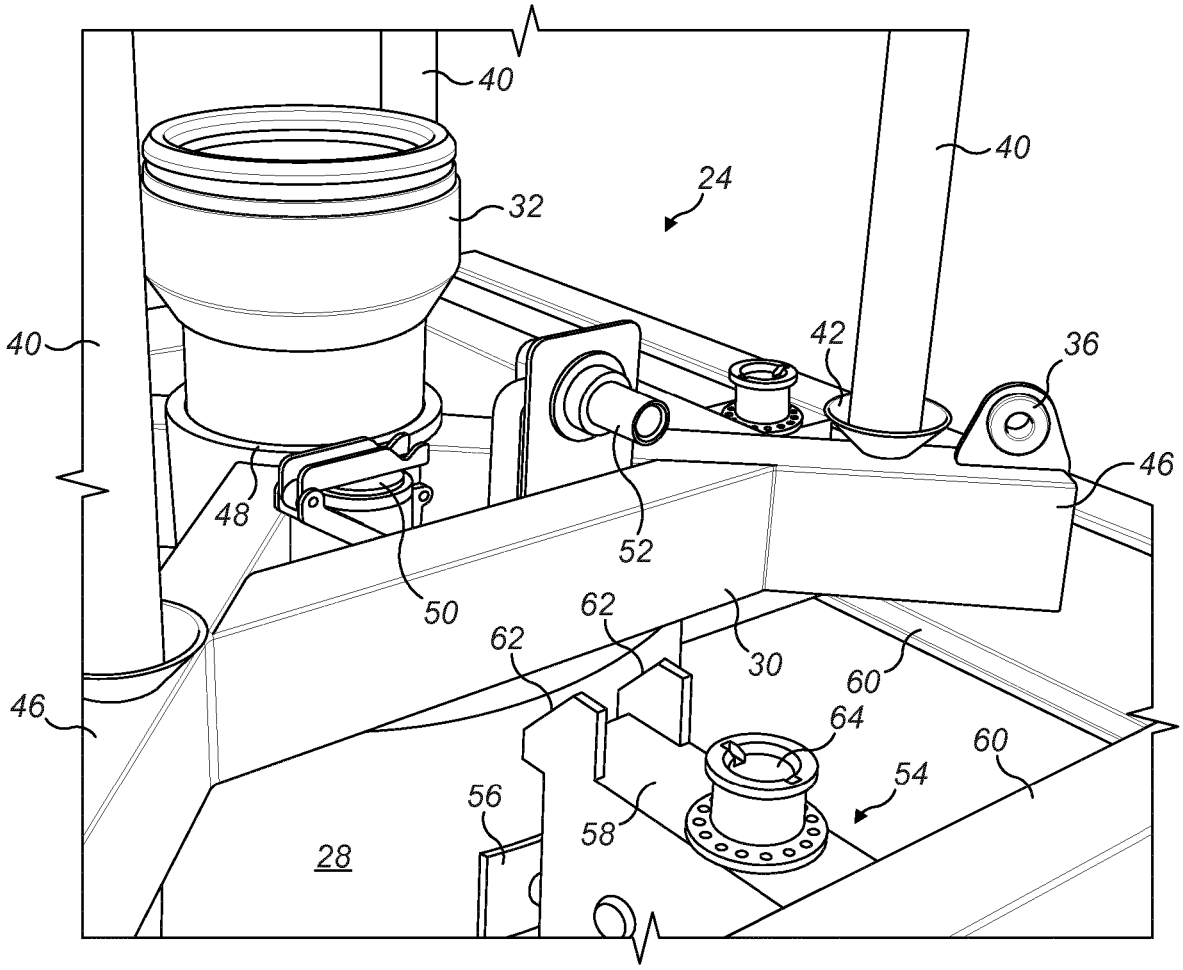
FIG. 3 is an enlarged detail perspective view showing the top of the suction anchor and the upstanding guide posts.

When the suction anchor 28 and the conductor 32 have reached the intended depth in the seabed 16 as shown in FIG. 2, an ROV or diver fits upright guide posts 40 into sockets 42 in the anchor brace 30 as shown in more detail in FIG. 3. FIG. 2 shows that the guide posts 40 extend upwardly from the anchor brace 30 and through an opening 44 in the top of the SPU 10 left by removing a panel 20 above the bay 34.

In FIG. 2, there are two guide posts 40 that extend from diagonally-opposed sockets 42 and hence are mutually opposed about the conductor 32. In FIGS. 3 and 4, there are more guide posts 40 and they are arranged differently in the sockets 42.

FIGS. 3 and 4 show the arrangement of the suction anchor assembly 24 in more detail, including the relationship between the suction anchor 28, the anchor brace 30 and the conductor 32. Here, it will be apparent that the anchor brace 30 comprises cross-members 46 that intersect centrally at a tubular support collar 48. The support collar 48 receives the conductor 32 telescopically. Opposed radially-extending arms of each cross-member 46 each support a respective one of the lifting points 36 and, inboard of the lifting point 36, one of the sockets 42 that receive one of the guide posts 40.

FIG. 3 also shows other features at the top of the suction anchor assembly 24, in particular: a vent hatch 50 that can also be used for contingency grouting; and a 'hot stab' connector 52 that enables suction pump operations with a high flow rate of, for example, 1500-2000 l/min.

Whilst not shown here, the suction anchor assembly 24 can also be fitted with survey equipment to capture and record accurate information as to heading, position and tilt of the suction anchor 28. Also, an analogue manometer can give direct pressure readings inside the suction anchor 28.

Figure 5:
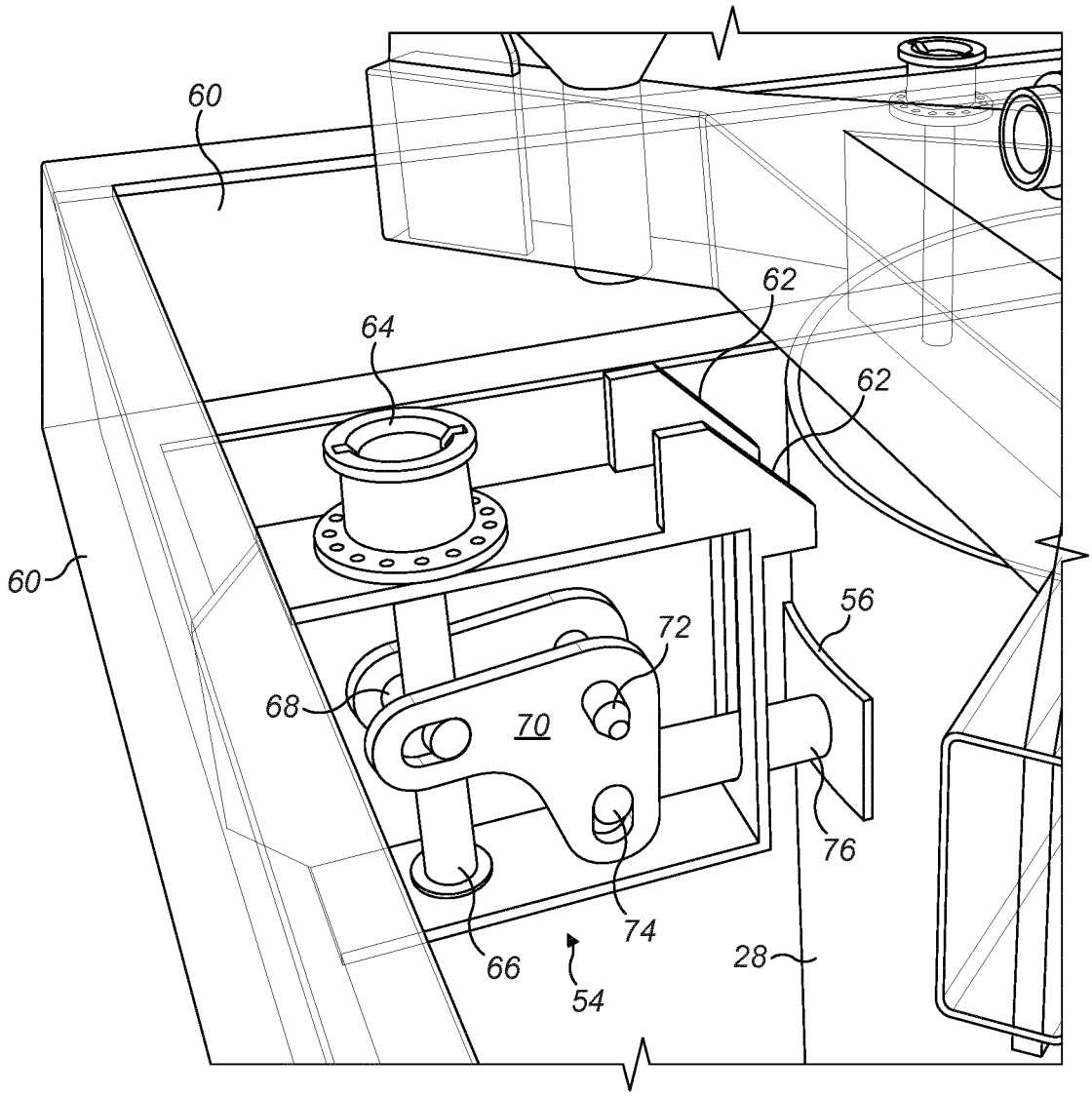
FIG. 5 is a partially cut-away perspective view of a clamping mechanism for fixing the suction anchor to a frame of the subsea processing unit.

A clamping system comprising multiple individually-operable clamps 54 around the suction anchor 28 is also evident in FIGS. 3 and 4. One of those clamps 54 is shown in detail in FIG. 5.

There are four clamps 54 in this example, equi-angularly spaced around the central longitudinal axis 34 of the suction anchor assembly 24. Clamp shoes 56 of the clamps 54 act radially inwardly upon the tubular wall of the suction anchor 28 in mutually-opposed pairs.

The clamp shoe 56 of each clamp 54 is movable relative to a respective clamp box 58. The clamp boxes 58 are fixed to respective beam members 60 of the frame 12 at the base 14 of the SPU 10. Four such beam members 60 form a rectangle or square around the suction anchor 28.

The suction anchor 28 is guided into a generally central position between the clamp boxes 58 by mutually-opposed, downwardly-converging guide formations 62 supported by the clamp boxes 58. For this purpose, the guide formations 62 define inwardly- and downwardly-inclined guide surfaces. The guide formations 62 thereby ensure that the suction anchor 28 is landed within tolerance for effective clamping, for example within a target box of ±0.2 m.

The lateral spacing between the opposed clamp boxes 58 exceeds the diameter of the tubular wall of the suction anchor 28. Consequently, there is a clearance between the clamp boxes 58 and the suction anchor 28. This clearance eases insertion of the suction anchor assembly 24 into the SPU 10.

The clearance around the suction anchor 28 may vary between the clamps 54, depending upon how centrally the suction anchor 28 is positioned between them. Differential clearance between the clamp boxes 58 and the suction anchor 28 is dealt with by advancing the clamp shoes 56 in radially inward directions to different extents.

Each clamp box 58 contains and supports a clamping mechanism that effects radial movement of the clamp shoes 56 in response to rotation of an upwardly-facing drive socket 64 that protrudes from the clamp box 58. The drive socket 64 is arranged to be engaged and turned by a standard Class 4 torque tool, which may conveniently be held by an ROV or diver in a routine manner.

Rotation of the drive socket 64 turns an upright threaded drive screw 66 that is fixed to the drive socket 64 to turn on a common axis. For this purpose, the drive screw 66 is supported by bearings that are fixed to the clamp box 58. Preferably, the drive screw 66 has a buttress thread for maximum strength.

A nut 68 is engaged with the drive rod 66 but is held against rotation. The nut 68 is thereby driven up or down the drive rod 66 depending upon the direction of rotation of the drive rod 66. The nut 68 is pivotably engaged with a bell crank 70, which therefore turns about a pivot 72 in response to movement of the nut 68 along the rod 66.

More specifically, a first arm of the bell crank 70 receives the nut 68 in a slot, whose elongation allows for variation in radius between the nut 68 and the pivot 72 of the bell crank 70 as the nut 68 moves along the straight rod 66.

A second arm of the bell crank 70 extends at about 90° to the first arm about the pivot 72. The second arm is pivotably engaged with a pin 74 near its free end opposite the pivot 72. The pin 74 is attached to a rod 76 that is constrained for straight radial movement with respect to the suction anchor 28. The clamp shoe 56 is fixed to a radially inner end of the rod 76.

The second arm also receives the pin 74 in a slot. The elongation of the slot allows for variation in radius between the pin 74 and the pivot 72 as the pin 74 and the rod 76 follow their straight path.

For strength and stability, the bell crank 70 in this example is bifurcated into two parallel plates, one each side of the drive rod 66, nut 68, pin 74 and rod 76.

It will be apparent that the bell crank 70 converts movement of the nut 68 along the drive rod 66, caused by rotating the drive socket 64, into radial movement of the rod 76 and hence of the clamp shoe 56 that is fixed to the rod 76.

By clamping the suction anchor 28 in this way, the frame 12 of the SPU 10 can be fixed or locked to the suction anchor assembly 24 when the suction anchor 28 and conductor 32 have been embedded into the seabed 16 to a desired extent as shown in FIGS. 2 and 3. Precise alignment between the suction anchor assembly 24 and the frame 12 of the SPU 10 is not necessary.

Locking the frame 12 to the suction anchor assembly 24 allows the base 14 of the SPU 10 to interact beneficially with the suction anchor 28 to form a more effective foundation than either structure could provide in isolation. Thus, for example, the base 14 of the SPU 10 spreads weight loads across a wider area of the seabed 16 and so relieves the suction anchor 28 from having to bear all of those loads. This means that the suction anchor 28 need not be as large and the integrated conductor 32 need not be as long as in prior art solutions.

As will be appreciated from FIG. 3 of the drawings, cross-members 46 of the anchor brace 30 may rest upon horizontal flanges of the surrounding beam members 60 at the base 14 of the SPU 10 when the suction anchor 28 is embedded fully into the seabed 16. This locates the suction anchor 28 axially against weight loads applied to the suction anchor 28. In this way, axial load is transferred from the anchor brace 30 into the base 14 of the SPU 10, which then distributes the load across the seabed 16. This allows the clamps 54 to be simplified as they need to provide only lateral location rather than axial location.

If the suction anchor 28 is not fully embedded in the seabed 16, some axial clearance could be left between the cross-members 46 of the anchor brace 30 and the horizontal flanges of the beam members 60. In any event, lateral clearance between the cross-members 46 and upright webs of the beam members 60 provides for tolerance in the lateral position of the suction anchor assembly 24 relative to the frame 12 of the SPU 10.

It will be recalled that the guide posts 40 upstanding from the sockets 42 in the anchor brace 30 extend upwardly through an opening 44 in the top 18 of the SPU 10. The guide posts 40 thereby facilitate aligning and landing further equipment directly on top of the suction anchor assembly 24. To exemplify such equipment, the sequence of drawings in FIGS. 6, 7 and 8 shows a Christmas tree 78 being lowered through the opening 44 into the bay 38 underneath.

Typically, a well will be drilled or completed before the Christmas tree 78 is installed into the SPU 10. The Christmas tree 78 can be installed either by a rig or a vessel.

Figure 6:
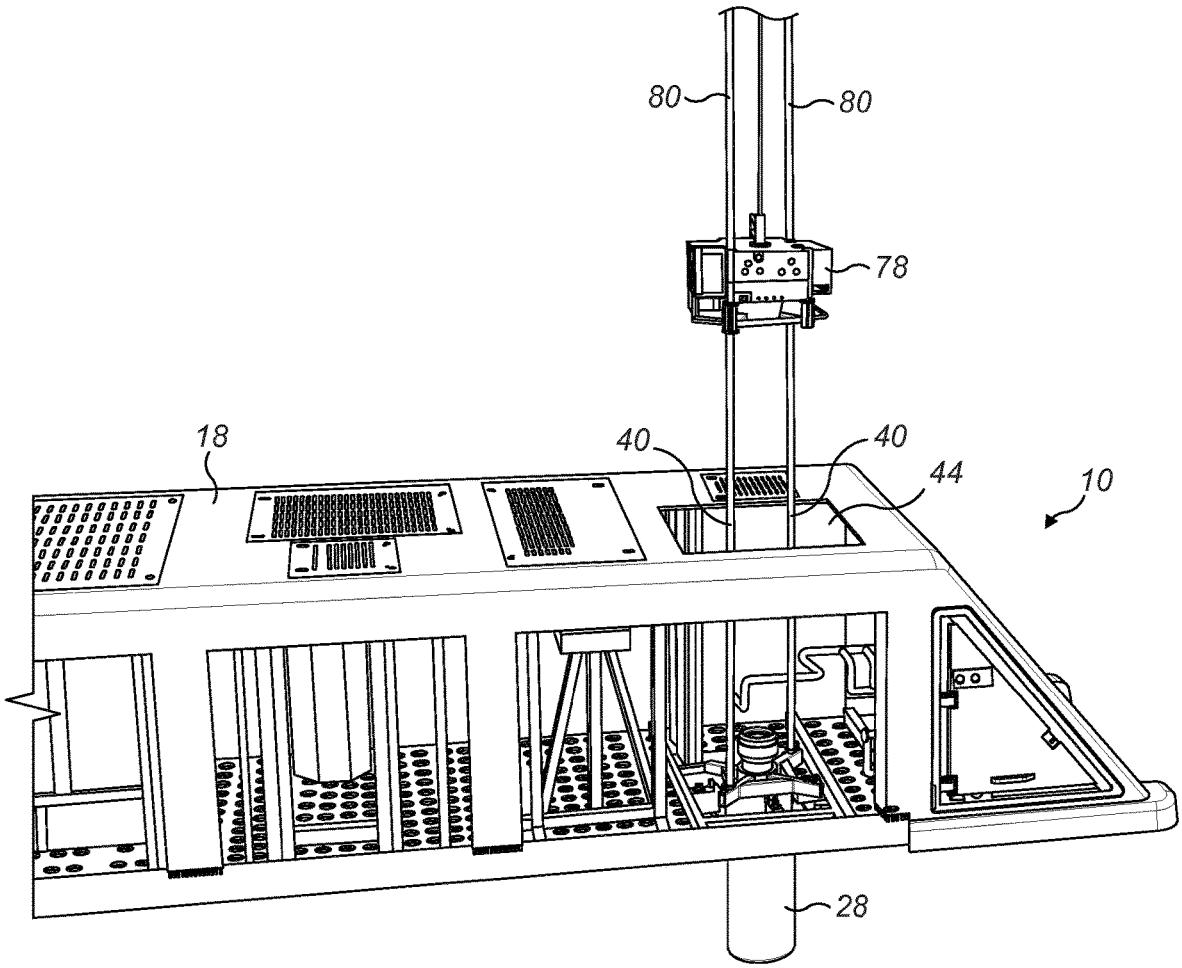
FIG. 6 is a perspective view of a Christmas tree being lowered into the subsea processing unit along the guide posts.

Initially, as shown in FIG. 6, the Christmas tree 78 is lowered toward the SPU 10 with the guidance of parallel guide wires 80. The guide wires 80 extend upwardly from the guide posts 40 and extend through parallel tubular passageways in the Christmas tree 78.

Figure 7:
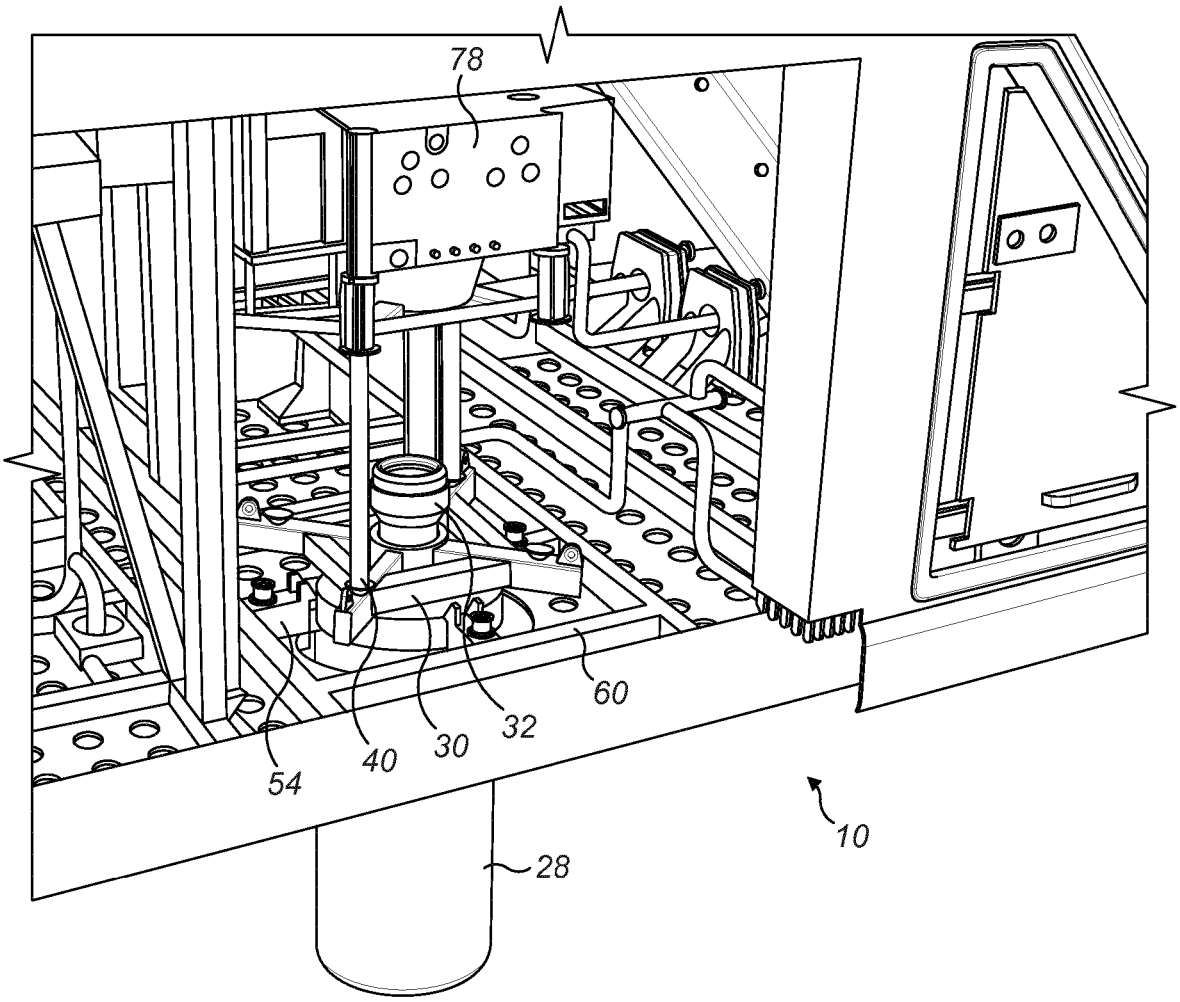
FIG. 7 is an enlarged detail perspective view showing the Christmas tree being lowered along the guide posts within the subsea processing unit.
Figure 8:
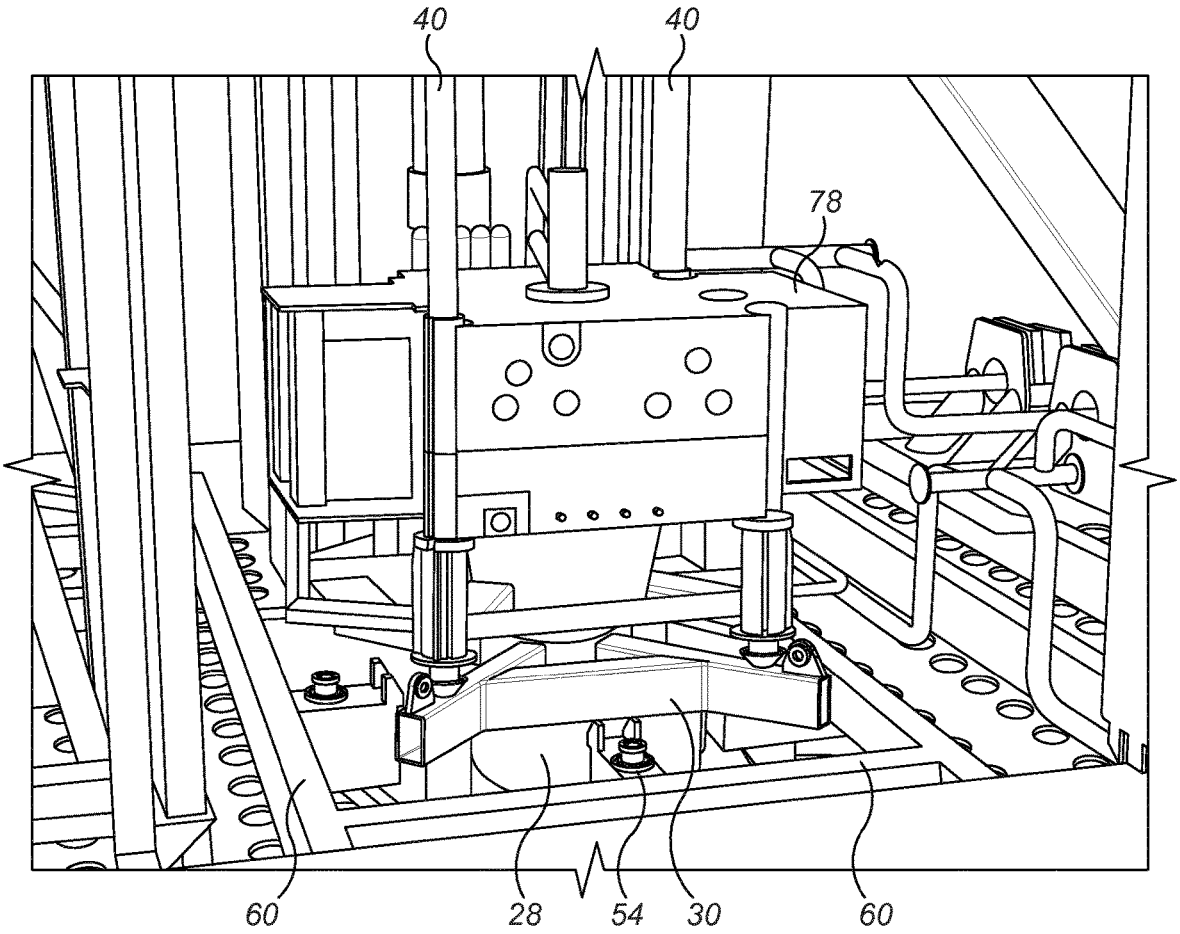
FIG. 8 is a further enlarged detail perspective view showing the Christmas tree now settled atop the suction anchor within the subsea processing unit.

FIG. 7 shows the Christmas tree 78 now engaged with the guide posts 40. The Christmas tree 78 has been lowered beneath the opening 44 in the top 18 of the SPU 10 and is approaching engagement with the top end portion of the conductor 32, which protrudes upwardly above the anchor brace 30 of the suction anchor assembly 24.

Finally, FIG. 8 shows the Christmas tree 78 now lowered fully into engagement with the top end portion of the conductor 32. The weight load of the Christmas tree 78 is now taken by the anchor brace 30 of the suction anchor assembly 24. That weight load is then distributed between the suction anchor 28 and the base 14 of the SPU 10 by virtue of the clamped connection between the suction anchor 28 and the frame 12 of the SPU 10.

It will be noted that any misalignment between the suction anchor 28 and the SPU 10 is immaterial. Not only do the clamps 54 compensate for any such misalignment but also the Christmas tree 78 needs only to be aligned accurately with the suction anchor 28 rather than with the SPU 10. The necessary alignment between the Christmas tree 78 and the suction anchor 28 is assured by the guide posts 40 being attached to the anchor brace 30 that surmounts the suction anchor 28. So, the weight of the Christmas tree 78 is supported directly by the suction anchor 28 and only indirectly by the base 14 of the SPU 10 via the clamps 54.

Once the Christmas tree 78 has been installed into the SPU 10 in this way, power, control and fluid connections are made between the Christmas tree 78 and the manifold and other equipment 22 within the SPU 10. Such connections are made to convey power, control signals and fluids to and from the Christmas tree 78. The removed panel 20 is also replaced to close the opening 44 above the bay 34.

In service, the conductor 32 will extend in length due to thermal expansion caused by the flow of hot fluids within and so will slide within the anchor brace 30 to move longitudinally relative to the surrounding suction anchor 28. Equipment atop the suction anchor assembly 24 that comprises the conductor 32, such as the Christmas tree 78, is therefore free to move to a limited extent relative to the surrounding frame 12 of the SPU 10. This requires some flexibility or slack in the connections between the Christmas tree 78 and the manifold and other equipment 22 within the SPU 10.

It is possible to clamp the frame 12 to the suction anchor 28 before or after installing equipment such as the Christmas tree 78 on top of the suction anchor assembly 24.

Many variations are possible within the inventive concept. For example, whilst the suction anchor is shown as being installed from a vessel into the SPU after tow-out of the SPU, a different installation sequence may be possible. In particular, the suction anchor could be pre-installed and secured in the SPU, whereupon a crane of a vessel may be used to lower that assembly to the seabed. In another approach, a suction anchor could be installed and used for drilling operations before the SPU is installed. The SPU can then be landed onto the guide base anchor.

The invention claimed is:

1. A method of installing a drilling conductor for a subsea well, the method comprising:

providing a suction anchor that is arranged to support the conductor within;

lowering the suction anchor toward a subsea processing unit at a seabed location, the processing unit having a frame defining a base that lies on the seabed and a top spaced from the base to accommodate equipment within the processing unit;

lowering the suction anchor into the processing unit through an opening of the top of the frame;

embedding the suction anchor into the seabed beneath the processing unit;

fixing the frame to the embedded suction anchor to form a structural unit that comprises the conductor, the suction anchor and the frame;

lowering additional equipment through the opening of the top of the frame and onto the conductor that is supported by the embedded suction anchor; and closing the opening in the top of the frame above the additional equipment on the conductor.

2. The method of claim 1, comprising lowering and embedding the suction anchor with the conductor already supported within.

3. The method of claim 1, further comprising the preliminary steps of:

towing the processing unit to an offshore installation site; and landing the processing unit onto the seabed at the installation site.

4. The method of claim 1, comprising transferring weight load of the additional equipment to the embedded suction anchor.

5. The method of claim 1, comprising fixing the frame to the embedded suction anchor before lowering the additional equipment onto the conductor.

6. The method of claim 1, comprising:

connecting one or more elongate guide elements to the embedded suction anchor; and lowering the additional equipment along the or each guide element.

7. The method of claim 6, comprising lowering the additional equipment through the top of the frame along the or each guide element, wherein the or each guide element extends upwardly from the embedded suction anchor and protrudes above the top of the frame.

8. The method of claim 1, comprising making power, control and/or fluid connections between the additional equipment and the equipment on board the subsea processing unit, after lowering the additional equipment onto the conductor.

9. The method of claim 1, comprising drilling a well through the conductor before lowering the additional equipment onto the conductor.

10. The method of claim 1, comprising fixing the frame to the embedded suction anchor by extending one or more clamps from the frame into clamping engagement with the suction anchor.

11. The method of claim 10, comprising extending two or more clamps into clamping engagement with the suction anchor, the clamps being extended fro the frame to different extents relative to each other.

12. The method of claim 1, comprising landing the suction anchor on the seabed within a landing area defined by the frame, before embedding the suction anchor into the seabed.

13. The method of claim 12, comprising aligning the suction anchor with the landing area by making aligning contact between the suction anchor and the frame while lowering the suction anchor toward the seabed.

14. The method of claim 12, wherein the landing area is wider than the suction anchor.

15. The method of claim 1, comprising resting a brace extending laterally from the suction anchor onto at least one member defining the frame.

16. A subsea processing unit, comprising:

a frame having a base arranged to lie on a seabed; and on-board equipment mounted on the base;

wherein the base of the frame defines a landing area for a suction anchor and supports a fixing system for fixing the suction anchor to the frame; and the frame further comprises a top spaced from the base, the top of the frame having an opening over the landing area for receiving the suction anchor, wherein the suction anchor is configured to be lowered through the opening in the top of the frame and embedded into the seabed beneath the processing unit, and wherein the opening in the top of the frame is configured to be closed above the suction anchor.

17. The unit of claim 16, wherein the fixing system comprises one or more clamp shoes that are extendable from the frame toward the landing area.

18. The unit of claim 17, wherein the fixing system comprises two or more clamp shoes that are extendable from the frame in mutually-opposed directions.

19. The unit of claim 18, wherein the clamp shoes are individually operable and extendable from the frame to if extents relative to each other.

20. The unit of claim 16, further comprising guide formations that are shaped to guide the suction anchor into alignment with the landing area.

21. The unit of claim 16, when installed on the seabed in combination with at least one suction anchor that is embedded into the seabed within the landing area and that is fixed by the fixing system to the frame, the or each suction anchor containing and supporting a tubular drilling conductor.

22. The unit of claim 21, wherein the or each suction anchor is surmounted by an anchor brace that connects the drilling conductor to the suction anchor.

23. The unit of claim 22, wherein the anchor brace defines upwardly facing locating points for additional subsequently installable wellhead equipment.

24. The unit of claim 22, wherein the anchor brace overlaps and lies upon at least one adjacent member of the frame.

25. The unit of claim 21, further comprising at least one upwardly extending elongate guide element connected to the or each suction anchor.

26. The unit of claim 25, wherein the or each suction anchor is surmounted by an anchor brace that connects the drilling conductor to the suction anchor, the anchor brace overlapping and lying upon at least one adjacent member of the frame, and wherein the or each guide element is attached to a locating point of the anchor brace.

27. The unit of claim 22, further comprising additional wellhead equipment mounted on the conductor.

28. The unit of claim 27, wherein the additional wellhead equipment comprises a blow-out preventer or a Christmas tree.

29. The unit of claim 27, further comprising power, control and/or fluid connections between the additional wellhead equipment and the on-board equipment.

* * * * *